US007683863B2

(12) United States Patent
Chiou et al.

(10) Patent No.: US 7,683,863 B2
(45) Date of Patent: Mar. 23, 2010

(54) ORGANIC LIGHT EMITTING DIODE DISPLAY AND PIXEL CIRCUIT THEREOF

(75) Inventors: Yu-Wen Chiou, Sinshih Township, Tainan County (TW); Chin-Tien Chang, Sinshih Township, Tainan County (TW); Hong-Ru Guo, Tainan Science-Based Industrial Park (TW)

(73) Assignees: Himax Technologies Limited, Tainan County (TW); Chi Mei El, Tainan Science-Based Industrial Park (TW)

( * ) Notice: Subject to any disclaimer, the term of this patent is extended or adjusted under 35 U.S.C. 154(b) by 602 days.

(21) Appl. No.: 11/652,536

(22) Filed: Jan. 12, 2007

(65) Prior Publication Data

US 2007/0195018 A1 Aug. 23, 2007

(30) Foreign Application Priority Data

Feb. 17, 2006 (TW) ..... 95105430 A

(51) Int. Cl.
*G09G 3/32* (2006.01)

(52) U.S. Cl. ..... 345/82; 345/76

(58) Field of Classification Search ..... 345/82, 345/76

See application file for complete search history.

(56) References Cited

U.S. PATENT DOCUMENTS 6,501,466 B1 * 12/2002 Yamagishi et al. ..... 345/204
2004/0222749 A1 * 11/2004 Koyama ..... 315/169.3

* cited by examiner

*Primary Examiner*—Richard Hjerpe
*Assistant Examiner*—Saifeldin Elnafia
(74) *Attorney, Agent, or Firm*—Rabin & Bardo, PC

(57) ABSTRACT

An OLED display and pixel circuit thereof are provided. The pixel circuit includes first and second switches, first and second PMOS transistors, a capacitor and an OLED. The first switch, controlled by a first scan signal, has a first end receiving a data signal and a second end. The second switch, controlled by a second scan signal, has a third end coupled to the second end and a fourth end. The first PMOS transistor has a source coupled to a high voltage, a drain coupled to the fourth end and a gate coupled to the second end. The second PMOS transistor has a gate coupled to the second end and a source coupled to the high voltage. The capacitor is coupled to the gate of the first PMOS transistor and the high voltage. The OLED has a positive end coupled to a drain of the second PMOS transistor.

36 Claims, 4 Drawing Sheets

ORGANIC LIGHT EMITTING DIODE DISPLAY AND PIXEL CIRCUIT THEREOF

This application claims the benefit of Taiwan application Serial No. 95105430, filed Feb. 17, 2006, the subject matter of which is incorporated herein by reference.

BACKGROUND OF THE INVENTION

1. Field of the Invention

The invention relates in general to a display and pixel circuit thereof, and more particularly to an organic light emitting diode (OLED) display and pixel circuit thereof.

2. Description of the Related Art

Referring to FIG. 1, a circuit diagram of a conventional OLED pixel circuit is shown. An OLED pixel circuit 100 includes metal oxide semiconductor (MOS) transistors T1~T4, a capacitor C1 and an OLED O1. When the MOS transistors T1 and T2 are turned on, data Idata is inputted to the pixel circuit 100. When the MOS transistors T1 and T2 are turned off, the capacitor C1 has stored data to light up the OLED O1.

However, in order to turn off the MOS transistor T2, the gate voltage of the MOS transistor T2 has to be decreased and thus the voltage at node A drops down due to a clock feed through effect. The clock feed through effect affects the voltage level of the capacitor C1 and results in luminance variation of the OLED O1.

Referring to FIG. 2, a circuit diagram of another conventional OLED pixel circuit is shown. A pixel circuit 200 includes MOS transistors M1~M5, a capacitor Cs and an OLED O2. In order to eliminate the clock feed through effect, the pixel circuit 200 controls the MOS transistor M2 by a signal S1 and controls the MOS transistor M3 by a signal S1B with an inverse phase to the signal S1. However, the pixel circuit 200, as compared to the pixel circuit 100, requires an extra MOS transistor, thereby reducing aperture ratio and increasing cost.

SUMMARY OF THE INVENTION

The invention is directed to an OLED display and pixel circuit thereof to eliminate the clock feed through effect without using an extra switch.

According to a first aspect of the present invention, an OLED pixel circuit is provided. The OLED pixel circuit includes a first switch, second switch, first PMOS transistor, second PMOS transistor, capacitor and an OLED. The first switch has a first end for receiving a data signal and a second end, and is turned on or off under control of a first scan signal. The second switch has a third end coupled to the second end and a fourth end, and is turned on or off under control of a second scan signal. The first PMOS transistor has a source coupled to a high voltage, a drain coupled to the fourth end of the second switch and a gate coupled to the second end. The second PMOS transistor has a gate coupled to the second end and a source coupled to the high voltage. The capacitor is coupled to the gate of the first PMOS transistor and the high voltage. The OLED has a positive end coupled to a drain of the second PMOS transistor, and a negative end coupled to a low voltage.

According to a second aspect of the present invention, an OLED display is provided. The OLED display includes a scan driver, data driver and a pixel circuit. The scan driver is for providing a first scan signal and a second scan signal. The data driver is for providing a data signal. The pixel circuit includes a first switch, second switch, first PMOS transistor, second PMOS transistor, capacitor and an OLED. The first switch has a first end for receiving the data signal and a second end, and is turned on or off under control of the first scan signal. The second switch has a third end coupled to the second end and a fourth end, and is turned on or off under control of the second scan signal. The first PMOS transistor has a source coupled to a high voltage, a drain coupled to the fourth end of the second switch and a gate coupled to the second end. The second PMOS transistor has a gate coupled to the second end and a source coupled to the high voltage. The capacitor is coupled to the gate of the first PMOS transistor and the high voltage. The OLED has a positive end coupled to a drain of the second PMOS transistor, and a negative end coupled to a low voltage.

The invention will become apparent from the following detailed description of the preferred but non-limiting embodiments. The following description is made with reference to the accompanying drawings.

DETAILED DESCRIPTION OF THE INVENTION

Figure 1:
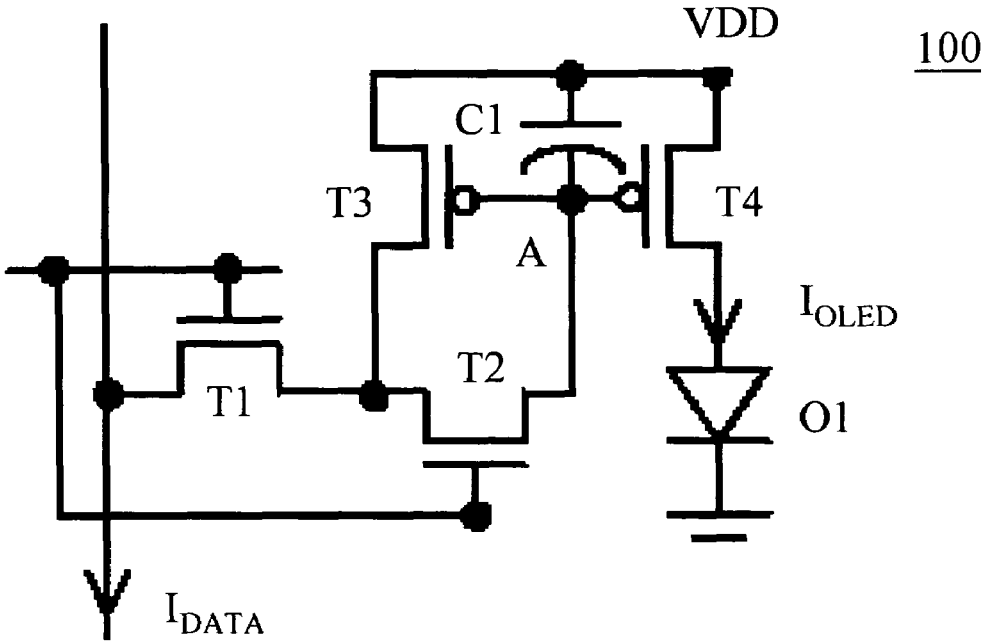
FIG. 1(PRIOR ART)
FIG. 1 is a circuit diagram of a conventional OLED pixel circuit.
Figure 2:
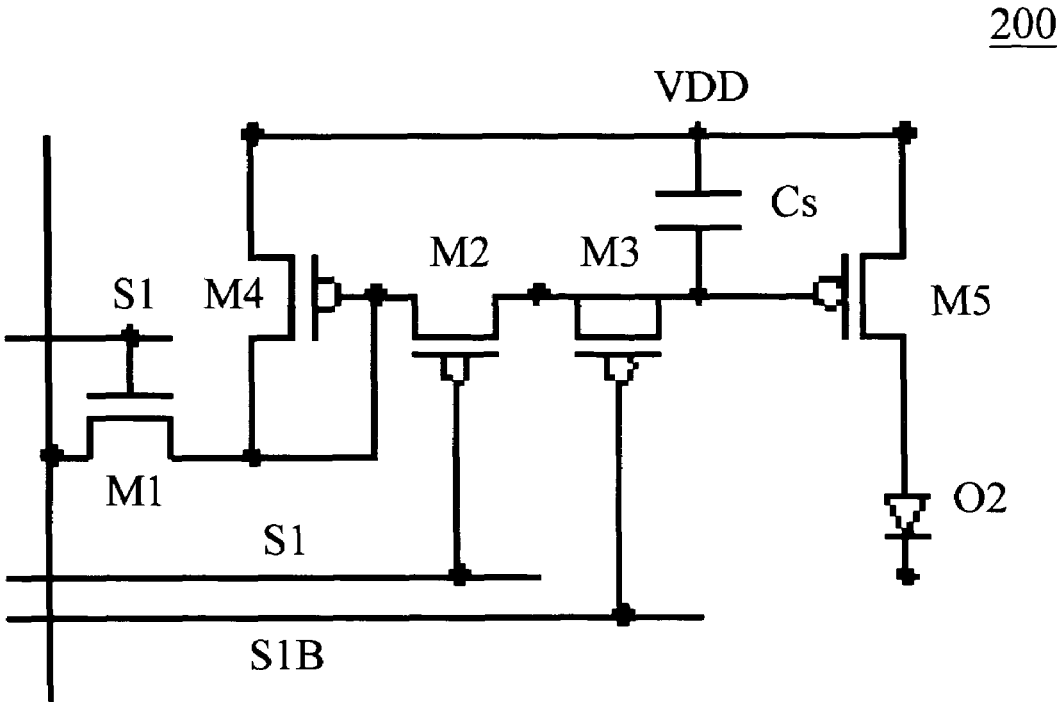
FIG. 2(PRIOR ART)
FIG. 2 is a circuit diagram of another conventional OLED pixel circuit.
Figure 3:
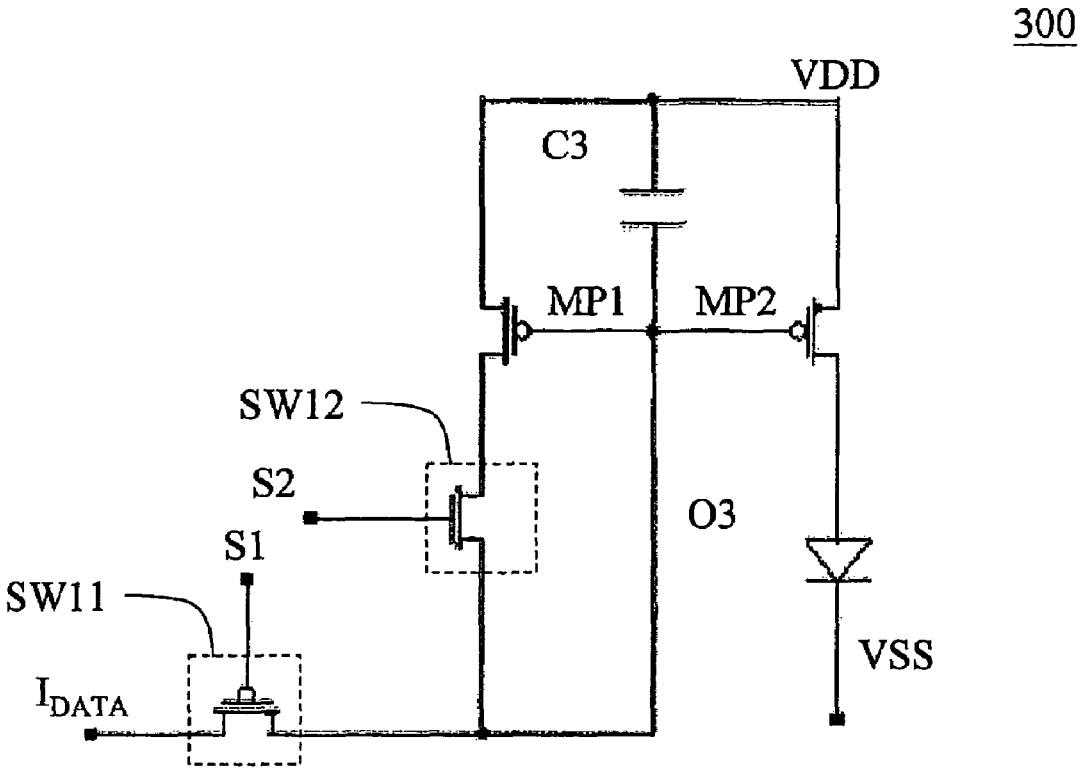
FIG. 3 is a circuit diagram of an OLED pixel circuit according to a first embodiment of the invention.

Referring to FIG. 3, a circuit diagram of an OLED pixel circuit according to a first embodiment of the invention is shown. A pixel circuit 300 includes switches SW11 and SW12, p-type MOS (PMOS) transistors MP1 and MP2, a capacitor C3 and an OLED O3. The switch SW11 has a first end and a second end. The first end is for receiving a data signal IDATA. The switch SW11 is turned on/off under control of a first scan signal S1. The switch SW12 has a third end and a fourth end. The third end is coupled to the second end of the switch SW11. The switch SW12 is turned on/off under control of a second scan signal S2.

The PMOS transistor MP1 has a source coupled to a high voltage VDD, a drain coupled to the fourth end of the switch SW12 and a gate coupled to the second end. The PMOS transistor MP2 has a gate coupled to the second end, and a source coupled to the high voltage VDD. The capacitor C3 is coupled to the gate of the PMOS transistor MP1 and the high voltage VDD. The OLED O3 has a positive end coupled to a drain of the PMOS transistor MP2 and a negative end coupled to a low voltage VSS.

In the embodiment, the switch SW11 is a PMOS transistor, the first end is a drain of the PMOS transistor, the second end is a source of the PMOS transistor and a gate of the PMOS transistor receives the first scan signal S1. The switch SW12 is an n-type MOS (NMOS) transistor. The third end is a source of the NMOS transistor, the fourth end is a drain of the NMOS transistor and a gate of the NMOS transistor receives the second scan signal S2.

Figure 4:
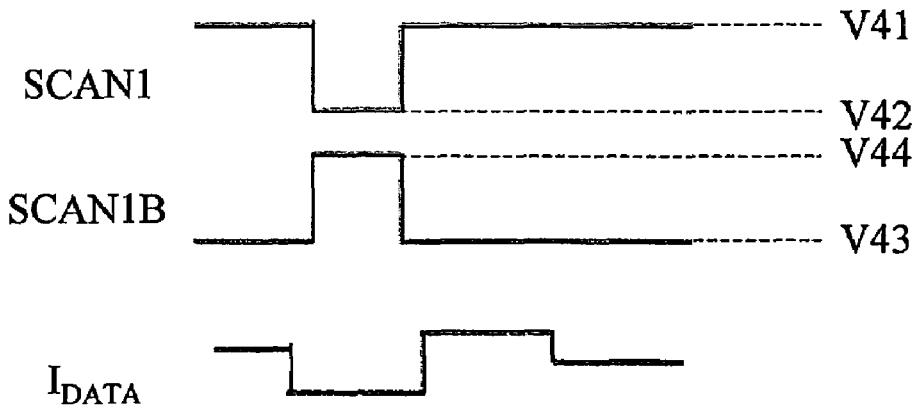
FIG. 4 is a waveform diagram of signals in the pixel circuit of the first embodiment.

Referring to FIG. 4, a waveform diagram of signals in the pixel circuit 300 of the first embodiment is shown. Referring to FIG. 3 and FIG. 4 at the same time, the first scan signal S1 is a scan signal SCAN1 and the second scan signal S2 is a scan signal SCAN1B, which has an inverse phase to the scan signal SCAN1. When the data signal IDATA is inputted to the pixel circuit 300, the scan signal SCAN1 drops down from a voltage level V41 to V42 to turn on the PMOS transistor of the switch SW11. The scan signal SCAN1B rises up from a voltage level V43 to V44 to turn on the NMOS transistor of the switch SW12. At the time, the data signal IDATA is stored in the capacitor C3.

When the data signal IDATA is stopped inputting to the pixel circuit 300, the scan signal SCAN1 rises from the voltage level V42 to V41 and the scan signal SCAN1B drops down from the voltage level V44 to V43 to turn off the switches SW11 and SW12. The switches SW11 and SW12 are turned off at the same time. Or the scan signal SCAN1B drops down from the voltage level V44 to V43 before the time when the scan signal SCAN1 rises up from the voltage level V42 to V41 and thus the switch SW12 is turned off before the switch SW11.

Figure 5:
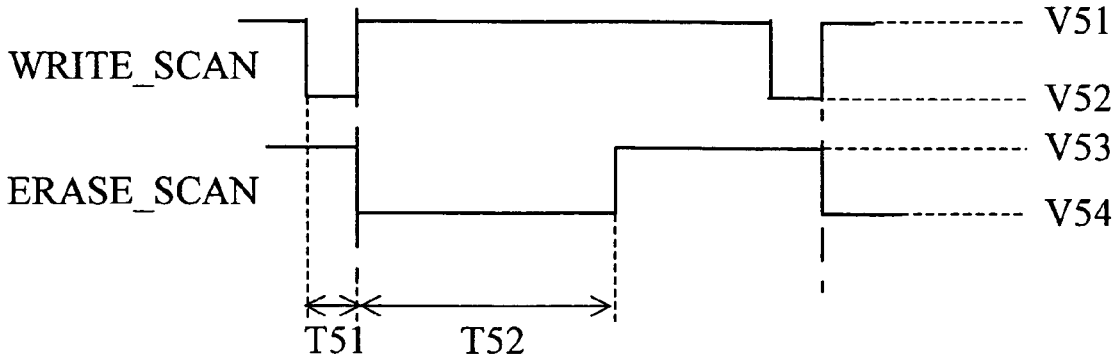
FIG. 5 is another waveform diagram of the signals of the pixel circuit in the first embodiment.

Referring to FIG. 5, another waveform diagram of the signals of the pixel circuit 300 in the first embodiment is shown. In FIG. 5, the first scan signal S1 is a scan signal WRITE_SCAN and the second scan signal S2 is a scan signal ERASE_SCAN. The scan signal WRITE_SCAN drops down from a voltage level V51 to V52 to turn on the PMOS transistor of the switch SW11 and input the data signal IDATA to the pixel circuit 300. After a period of time T51, the scan signal ERASE_SCAN drops down from a voltage level V53 to V54 to turn off the NMOS transistor of the switch SW12.

At a period of time T52 after the NMOS transistor of the switch SW11, the scan signal ERASE_SCAN rises up from the voltage level V54 to V53 to turn on the NMOS transistor and reset the capacitor C3 to release charges stored in the capacitor C3. The driving method in FIG. 5 is a pulse-type method.

Figure 6:
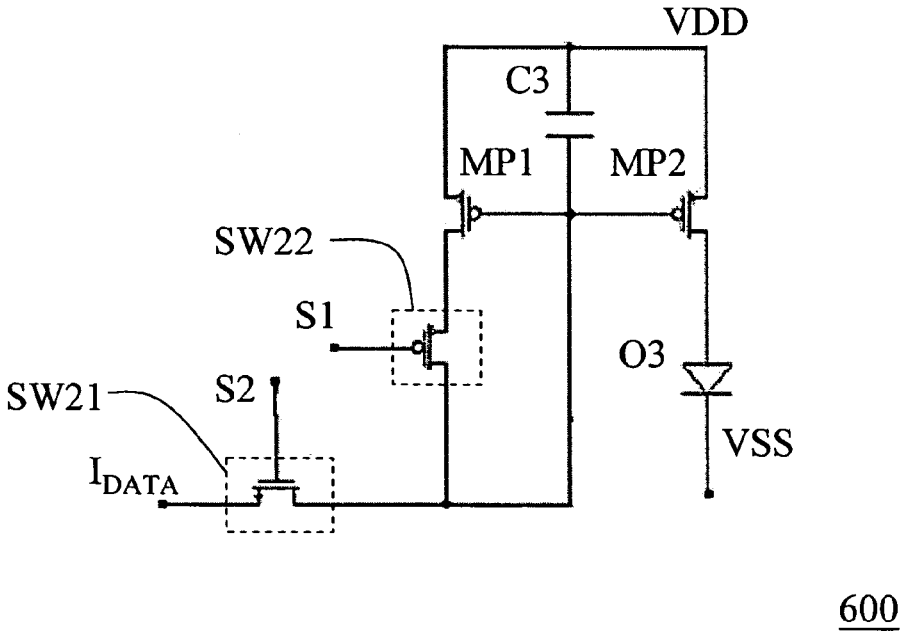
FIG. 6 is a circuit diagram of an OLED pixel circuit according to a second embodiment of the invention.

Referring to FIG. 6, a circuit diagram of an OLED pixel circuit according to a second embodiment of the invention is shown. The difference between the pixel circuit 600 and the pixel circuit 300 of the first embodiment lies in that the switch SW11 is substituted by the NMOS transistor of the switch SW21 and the switch SW12 is substituted by the PMOS transistor of the switch SW22. The SW21 has a first end for receiving the data signal IDATA and a second end, and is turned on/off under control of a first scan signal S2. The switch SW22 has a third end and a fourth end. The third end is coupled to the second end of the switch SW21 and the switch SW22 is turned on/off under control of a second scan signal S1. The first end is a source of the NMOS transistor of the SW21, the second end is a drain of the NMOS transistor and the gate of the NMOS transistor receives the first scan signal S1'. The third end is a drain of the PMOS transistor of the switch SW22, the fourth end is a source of the PMOS transistor and the gate of the PMOS transistor receives the second scan signal S2'.

Referring to FIG. 4, in the embodiment, the first can signal S1' is the scan signal SCAN1B and the second scan signal S2' is the scan signal SCAN1 for instance. When the data signal IDATA is inputted to the pixel circuit 600, the scan signal SCAN1 drops down from the voltage level V41 to V42 to turn on the PMOS transistor of the switch SW22; the scan signal SCAN1B rises up from the voltage level V43 to V44 to turn on the NMOS transistor of the switch SW21. At the time, the data signal IDATA is stored in the capacitor C3.

When the data signal IDATA is stopped inputting to the pixel circuit 600, the scan signal SCAN1 rises up from the voltage level V42 to V41, the scan signal SCAN1B drops down from the voltage level V44 to V43 to turn off the switches SW22 and SW21. The switches SW22 and SW21 are turned off at the same time. Or the scan signal SCAN1 rises up from the voltage level V42 to V41 before the time when the scan signal SCAN1B drops down from the voltage level V44 to V43 and thus the switch SW22 is turned off before the switch SW21.

Figure 7:
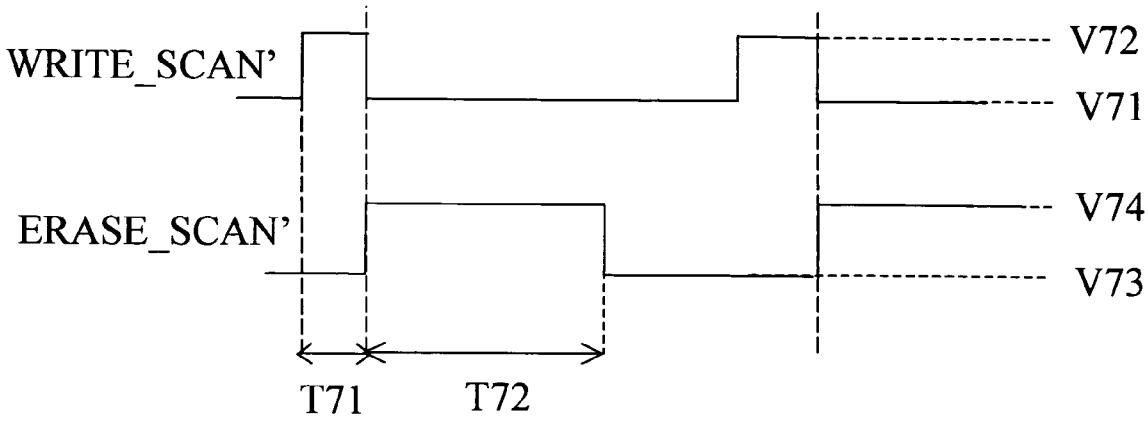
FIG. 7 is another waveform diagram of the signals of the pixel circuit in the second embodiment.

Referring to FIG. 7, another waveform diagram of the signals of the pixel circuit 600 in the second embodiment is shown. In the embodiment, the first scan signal S1' is a scan signal WRITE_SCAN' and the second scan signal S2' is a scan signal ERASE_SCAN'. The scan signal WRITE_SCAN' rises up from a voltage level V71 to V72 to turn on the NMOS transistor of the switch SW21 and input the data signal IDATA to the pixel circuit 600. After a period of time T71, the scan signal ERASE_SCAN' rises up from a voltage level V73 to V74 to turn off the PMOS transistor of the switch SW22.

At a period of time T72 after the PMOS transistor of the switch SW22, the scan signal ERASE_SCAN' drops down from the voltage level V74 to V73 to turn on the PMOS transistor and reset the capacitor C3 to release charges stored in the capacitor C3. The driving method in FIG. 7 is a pulse-type method.

The above-mentioned pixel circuits 300 and 600 are active matrix OLED (AMOLED) pixel circuits.

Figure 8:
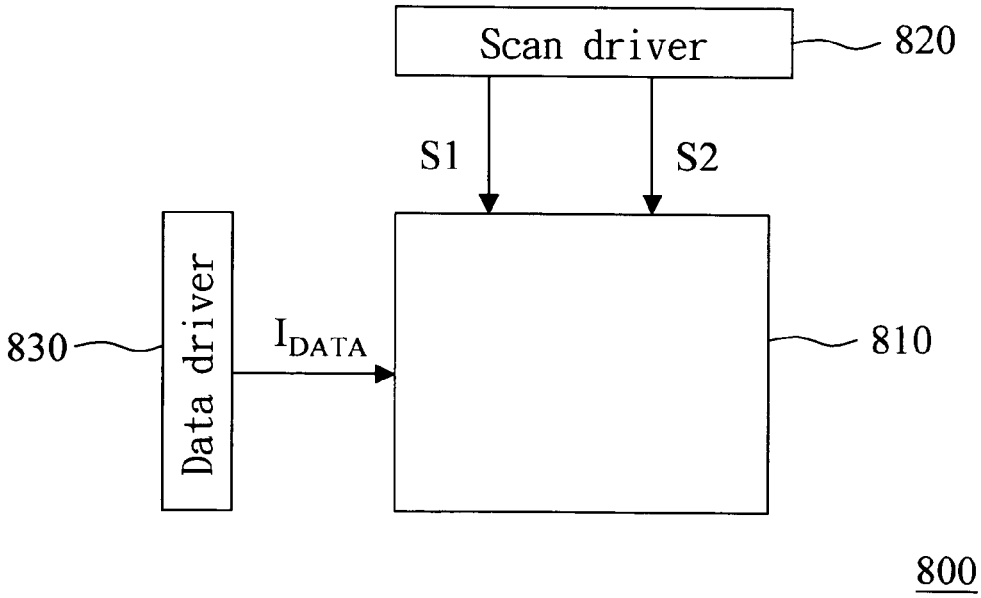
FIG. 8 is a block diagram of an OLED display of the invention.

Referring to FIG. 8, a block diagram of an OLED display of the invention is shown. A display 800 includes a pixel matrix 810, scan driver 820 and data driver 830. The scan driver 820 provides the first scan signal S1 and the second scan signal S2. The data driver 830 provides data signal IDATA. The pixel matrix includes a number of pixel circuits, such as the pixel circuits 300 and 600. The scan driver drives the pixel circuit 300 or 600 of the pixel matrix 810 by the first scan signal S1 and the second scan signal S2.

The OLED display and pixel circuit thereof disclosed by the above-mentioned embodiment of the invention can eliminate the prior-art issue due to the clock feed through effect. Moreover, compared to the conventional pixel circuit, the pixel circuit of the invention can eliminate the clock feed through effect without requiring an extra MOS switch and thus the aperture ratio will not be reduced.

While the invention has been described by way of example and in terms of two preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An organic light emitting diode (OLED) pixel circuit, comprising:

a first switch, having a first end for receiving a data signal and a second end, and turned on or off under control of a first scan signal;

a second switch, having a third end coupled to the second end and a fourth end, and turned on or off under control of a second scan signal;

a first p-type metal oxide semiconductor (PMOS) transistor, having a source coupled to a high voltage, a drain coupled to the fourth end of the second switch and a gate coupled to the second end;

a second PMOS transistor, having a gate coupled to the second end and a source coupled to the high voltage;

a capacitor, coupled to the gate of the first PMOS transistor and the high voltage; and an OLED, having a positive end coupled to a drain of the second PMOS transistor, and a negative end coupled to a low voltage.

2. The pixel circuit according to claim 1, wherein the first switch is a third PMOS transistor, the first end is a drain of the third PMOS transistor, the second end is a source of the third PMOS transistor and a gate of the third PMOS transistor receives the first scan signal.

3. The pixel circuit according to claim 2, wherein the second switch is a n-type metal oxide semiconductor (NMOS) transistor, the third end is a source of the NMOS transistor, the fourth end is a drain of the third NMOS transistor and a gate of the NMOS transistor receives the second scan signal.

4. The pixel circuit according to claim 3, wherein when the data signal is inputted to the pixel circuit, the first scan signal drops down from a first voltage level to a second voltage level to turn on the third PMOS transistor and the second scan signal rises up from a third voltage level to a fourth voltage level to turn on the NMOS transistor.

5. The pixel circuit according to claim 4, wherein when the data signal is stopped inputting to the pixel circuit, the first scan signal rises up from the second voltage level to the first voltage level and the second scan signal drops down from the fourth voltage level to the third voltage level to turn off the third PMOS transistor and the NMOS transistor.

6. The pixel circuit according to claim 2, wherein the NMOS transistor is turned off before the third PMOS transistor.

7. The pixel circuit according to claim 5, wherein the NMOS transistor and the third PMOS transistor are turned off at the same time.

8. The pixel circuit according to claim 3, wherein at a first period of time after the first scan signal drops down from a first voltage level to a second voltage level to turn on the third PMOS transistor and input the data signal to the pixel circuit, the second scan signal drops down from a third voltage level to a fourth voltage level to turn off the NMOS transistor.

9. The pixel circuit according to claim 8, wherein at a second period of time after the NMOS transistor is turned off, the second scan signal rises up from the fourth voltage level to the third voltage level to turn on the NMOS transistor and reset the capacitor.

10. The pixel circuit according to claim 1, wherein the first switch is a NMOS transistor, the first end is a source of the NMOS transistor, the second end is a drain of the NMOS transistor, and a gate of the NMOS transistor receives the first scan signal.

11. The pixel circuit according to claim 10, wherein the second switch is a third PMOS transistor, the third end is a drain of the third PMOS transistor, the fourth end is a source of the third PMOS transistor and a gate of the third PMOS transistor receives the second scan signal.

12. The pixel circuit according to claim 11, wherein when the data signal is inputted to the pixel circuit, the first scan signal rises up from a first voltage level to a second voltage level to turn on the NMOS transistor and the second scan signal drops down from a third voltage level to a fourth voltage level to turn on the third PMOS transistor.

13. The pixel circuit according to claim 12, wherein when the data signal is stopped inputting to the pixel circuit, the first scan signal drops down from the second voltage level to the first voltage level and the second scan signal rises up from the fourth voltage level to the third voltage level to turn off the third PMOS transistor and the NMOS transistor.

14. The pixel circuit according to claim 13, wherein the third PMOS transistor is turned off before the NMOS transistor.

15. The pixel circuit according to claim 13, wherein the NMOS transistor and the third PMOS transistor are turned off at the same time.

16. The pixel circuit according to claim 11, wherein at a first period of time after the first scan signal rises up from a first voltage level to a second voltage level to turn on the NMOS transistor and input the data signal to the pixel circuit, the second scan signal rises up from a third voltage level to a fourth voltage level to turn off the third PMOS transistor.

17. The pixel circuit according to claim 16, wherein at a second period of time after the third PMOS transistor is turned off, the second scan signal drops down from the fourth voltage level to the third voltage level to turn on the third PMOS transistor and reset the capacitor.

18. The pixel circuit according to claim 1, is an active matrix OLED (AMOLED) pixel circuit.

19. An OLED display, comprising:

a scan driver, for providing a first scan signal and a second scan signal;

a data driver, for providing a data signal; and a pixel circuit, comprising:

a first switch, having a first end for receiving the data signal and a second end, and turned on or off under control of the first scan signal;

a second switch, having a third end coupled to the second end and a fourth end, and turned on or off under control of the second scan signal;

a first PMOS transistor, having a source coupled to a high voltage, a drain coupled to the fourth end of the second switch and a gate coupled to the second end;

a second PMOS transistor, having a gate coupled to the second end and a source coupled to the high voltage;

a capacitor, coupled to the gate of the first PMOS transistor and the high voltage; and an OLED, having a positive end coupled to a drain of the second PMOS transistor, and a negative end coupled to a low voltage.

20. The display according to claim 19, wherein the first switch is a third PMOS transistor, the first end is a drain of the third PMOS transistor, the second end is a source of the third PMOS transistor and a gate of the third PMOS transistor receives the first scan signal.

21. The display according to claim 20, wherein the second switch is an NMOS transistor, the third end is a source of the NMOS transistor, the fourth end is a drain of the NMOS transistor and a gate of the NMOS transistor receives the second scan signal.

22. The display according to claim 21, wherein when the data signal is inputted to the display, the first scan signal drops down from a first voltage level to a second voltage level to turn on the third PMOS transistor and the second scan signal rises up from a third voltage level to a fourth voltage level to turn on the NMOS transistor.

23. The display according to claim 22, wherein when the data signal is stopped inputting to the display, the first scan signal rises up from the second voltage level to the first voltage level and the second scan signal drops down from the fourth voltage level to the third voltage level to turn off the third PMOS transistor and the NMOS transistor.

24. The display according to claim 20, wherein the NMOS transistor is turned off before the third PMOS transistor.

25. The display according to claim 23, wherein the NMOS transistor and the third PMOS transistor are turned off at the same time.

26. The display according to claim 21, wherein at a first period of time after the first scan signal drops down from a first voltage level to a second voltage level to turn on the third PMOS transistor and input the data signal to the display, the second scan signal drops down from a third voltage level to a fourth voltage level to turn off the NMOS transistor.

27. The display according to claim 26, wherein at a second period of time after the NMOS transistor is turned off, the second scan signal rises up from the fourth voltage level to the third voltage level to turn on the NMOS transistor and reset the capacitor.

28. The display according to claim 19, wherein the first switch is a NMOS transistor, the first end is a source of the NMOS transistor, the second end is a drain of the NMOS transistor, and a gate of the NMOS transistor receives the first scan signal.

29. The display according to claim 28, wherein the second switch is a third PMOS transistor, the third end is a drain of the third PMOS transistor, the fourth end is a source of the third PMOS transistor and a gate of the third PMOS transistor receives the second scan signal.

30. The display according to claim 29, wherein when the data signal is inputted to the display, the first scan signal rises up from a first voltage level to a second voltage level to turn on the NMOS transistor and the second scan signal drops down from a third voltage level to a fourth voltage level to turn on the third PMOS transistor.

31. The display according to claim 30, wherein when the data signal is stopped inputting to the display, the first scan signal drops down from the second voltage level to the first voltage level and the second scan signal rises up from the fourth voltage level to the third voltage level to turn off the third PMOS transistor and the NMOS transistor.

32. The display according to claim 31, wherein the third PMOS transistor is turned off before the third PMOS transistor.

33. The display according to claim 31, wherein the NMOS transistor and the third PMOS transistor are turned off at the same time.

34. The display according to claim 29, wherein at a first period of time after the first scan signal rises up from a first voltage level to a second voltage level to turn on the NMOS transistor and input the data signal to the display, the second scan signal rises up from a third voltage level to a fourth voltage level to turn off the third PMOS transistor.

35. The display according to claim 34, wherein at a second period of time after the third PMOS transistor is turned off, the second scan signal drops down from the fourth voltage level to the third voltage level to turn on the third PMOS transistor and reset the capacitor.

36. The display according to claim 19, is an AMOLED display.

* * * * *

UNITED STATES PATENT AND TRADEMARK OFFICE

CERTIFICATE OF CORRECTION

PATENT NO. : 7,683,863 B2
APPLICATION NO. : 11/652536
DATED : March 23, 2010
INVENTOR(S) : Yu-Wen Chiou et al.

It is certified that error appears in the above-identified patent and that said Letters Patent is hereby corrected as shown below:

On the Title Page, Item 73 (Assignees)

Second Assignee's name "CHI MEI EL" should be "CHI MEI EL CORP."

Signed and Sealed this
Twenty-fifth Day of September, 2012

David J. Kappos

David J. Kappos
*Director of the United States Patent and Trademark Office*